United States Patent [19]

Mäkinen et al.

[11] Patent Number: 4,596,291

[45] Date of Patent: Jun. 24, 1986

[54] FLOATING DRILLING PLATFORM

[75] Inventors: Eero Mäkinen, Espoo; Torsten Heideman, Kauniainen, both of Finland

[73] Assignee: Oy Wärtsilä Ab, Helsinki, Finland

[21] Appl. No.: 503,326

[22] Filed: Jun. 10, 1983

[30] Foreign Application Priority Data

Jun. 15, 1982 [FI] Finland ..... 822159

[51] Int. Cl.[4] ..... B63B 35/08; B63B 35/44

[52] U.S. Cl. ..... 175/5; 114/40; 114/265; 405/211; 405/217

[58] Field of Search ..... 405/61, 201, 211, 217, 405/196; 114/40, 41, 42, 264, 265; 175/5, 7, 8, 9

[56] References Cited

U.S. PATENT DOCUMENTS 3,894,504 7/1975 Smith ..... 114/42
4,073,144 2/1978 Lea ..... 405/217 X
4,295,758 10/1981 Yashima ..... 405/201
4,434,741 3/1984 Wright et al. ..... 114/264

*Primary Examiner*—David H. Corbin
*Attorney, Agent, or Firm*—Dellett, Smith-Hill and Bedell

[57] ABSTRACT

A floating semisubmersible off-shore drilling platform or the like comprises an upper working level portion and a lower pontoon portion. When the platform is transported from one place to another, it floats on the pontoon portion, but when it is working as a stationary unit in open water, it is submerged deeper, so that the pontoon portion is at a considerable distance below the water surface and the working level portion is at a considerable distance above the water surface. The platform is adapted to withstand ice pressure from ice occurring in the ambient water by giving the pontoon portion of the platform a form particularly advantageous in ice conditions. When ice occurs, the platform is lifted to such a position, that its pontoon portion comes to float at the water surface level.

1 Claim, 4 Drawing Figures

Figure 1:
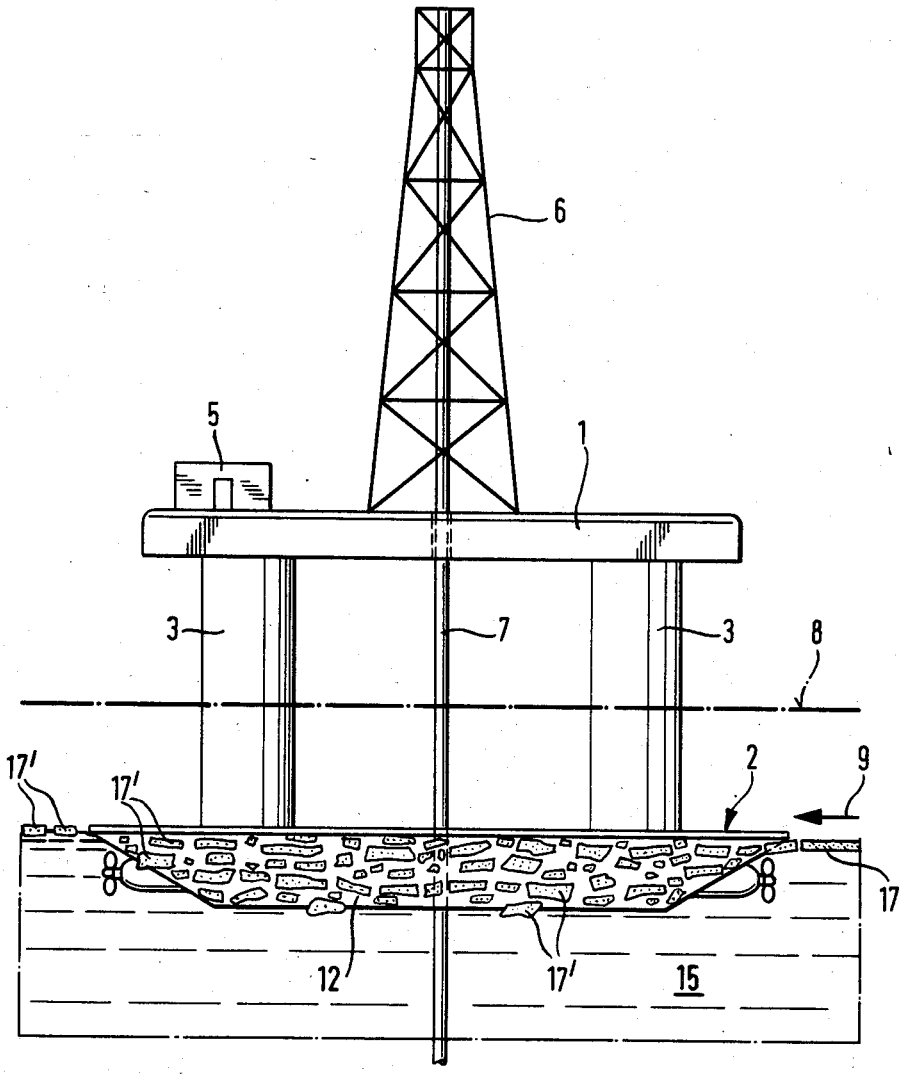

III 6
6a
13
1
3
7
3
11
20
3
12a
10
15
12b
18
19
14
7
7

FLOATING DRILLING PLATFORM

The invention relates to a method for using a floating semisubmersible off-shore drilling platform or the like in ice conditions, which platform comprises an upper working level portion and a lower pontoon portion, and which normally, when moving from one place to another, floats on the pontoons of the pontoon portion, but, when working in open-water as a stationary operating unit, is more deeply submerged, so that the pontoon portion is a substantial distance below the water surface and the working level portion is a substantial distance above the water surface. The invention also relates to a drilling platform adapted for the application of said method.

Transport of a semisubmersible drilling platform usually takes place with the pontoons of the pontoon portion floating at the water surface and working as platform moving vessels. It has been suggested that the pontoons be formed to break ice, to enable the platform to move through ice fields. This suggestion, however, does not solve all the problems caused by ice, because most of the time the platform works in a lowered stationary position and may have to meet the pressure of a moving ice field. The moving of a platform through an ice field does not cause very big problems, because in that case ice breaker aid can always be used for assisting and for opening of a passage way.

The object of the invention is to present a method, by means of which a semisubmersible platform, while stationary, for example anchored or kept stationary by a dynamic positioning system, can nevertheless be used in very difficult ice conditions.

In accordance with one aspect of the present invention there is provided a method for using a floating semisubmersible off-shore drilling platform or the like in ice-filled waters, which platform comprises an upper work-level portion and a lower pontoon portion, comprising at least one pontoon, and which platform, when being transported from one place to another, floats on said pontoon portion, but when working as a stationary unit in open water, is submerged deeper to have said pontoon portion at a considerable distance below the water surface and said working level portion at a considerable distance above the water surface, said method including the steps of giving said pontoon portion a form particularly advantageous in ice conditions, and lifting said platform, when it is to be used as a stationary unit in ice-filled waters, to such a position, that its pontoon portion floats at the water surface level.

In accordance with a second aspect of the present invention there is provided a floating, adjustably submersible off-shore drilling platform comprising a lower pontoon portion, an upper working portion supported above the pontoon portion, a drill for drilling the sea bottom, said drill extending downwards in use from the working portion of the platform, and an ice shield surrounding the drill at the level of the pontoon portion to protect the drill from floating ice when said pontoon portion is at the level of the water surface.

The method of the invention does not require any large structure changes in the platform itself, but the effeciency of the method can be decisively improved in ice conditions by modifying the conventional semisubmersible platform structure.

The invention is based on the thought that the environment conditions in an open-water situation completely differ from ice conditions and that this fact can be taken advantage of by changing the height position of the drilling platform according to the conditions, so that in ice conditions the best ice breaking part is on the water surface level to minimize the ice load acting on the platform.

In a drilling platform adapted for the application of the method according to the invention, the drill shaft is provided with an ice shield. This shield can be a separate part supported by the pontoons or by other structures. Such an arrangement can be used when the ice conditions are not very severe. In really difficult ice conditions, it is recommendable to use another arrangement withstanding greater load. According to this alternative the whole drilling tower is horizontally moved in a way known per se so that the drilling takes place through an opening in the pontoon portion. The drill shaft is then completely surrounded by the pontoon, and hence is well sheltered from ice load.

The pontoons are provided with propellers for the transportation of the drilling platform, for keeping it stationary and/or for turning it into the most favourable direction in relation to the ice load. In a platform according to the invention, it is of advantage to have, at both ends of the pontoon, at least one propeller capable of withstanding heavy ice load and being connected to a drive machinery powerful enough to meet the ice conditions. Such a propeller, designed to operate in ice, is able to crush ice pieces and flush the outer surfaces of the pontoons by water in order to reduce friction between the pontoon and the ambient ice.

In semisubmersible platforms, the pontoons of the pontoon portion are usually made barge shaped. This means that the pontoons, viewed from above are generally rectangular with parallel sides over their whole length. This form can be used also in a platform according to the invention. However, it is convenient to make both ends of the pontoons suitable for ice breaking. This is obtained by making the fore and back end planes of the pontoons, at least close to the water line and below it, inclined in relation to a horizontal plane 15° . . . 50°, preferably 25° . . . 45°.

A barge shaped hull does not have the best possible ice breaking shape. As known, the best ice breaking bow shape is a V-shaped considerably forwardly inclined bow, the sharp edge of which has been made round or flat. In a platform according to the invention, it is not suitable to make the ends of the pontoons V-shaped, because that would result in the space between the pontoons being convergent in the V-shaped bow and stern part area. A convergent area between two rigid structures is quite harmful in ice conditions, because the ice masses will have to fit into an narrowing space when moving between said structures. Then there will be a wedge effect, as a result of which the whole ice mass becomes wedged tightly, causing extremely high lateral stess on the structures and high ice resistance. Because of this, the pontoons should be built so that the space between them is of uniform thickness, or possibly is somewhat broadening seen in the ice moving direction. This can be achieved by forming the pontoons like two separated halves of an ice breaking vessel arranged to form an intermediate space of uniform width over its entire length.

Also other features, which have proved to be of advantage in ice breaking vessels, can be applied when designing the pontoons. For example, the outside of the pontoons can be inclined so that the width of the pontoon is diminishing downwards. A suitable angle of side inclination is thereby 0° . . . 15°. It is also of advantage to use, in the pontoons the air bubbling system described in U.S. Pat. No. 3,580,204, hereby incorporated by reference. This system decreases the ice resistance.

Figure 2:
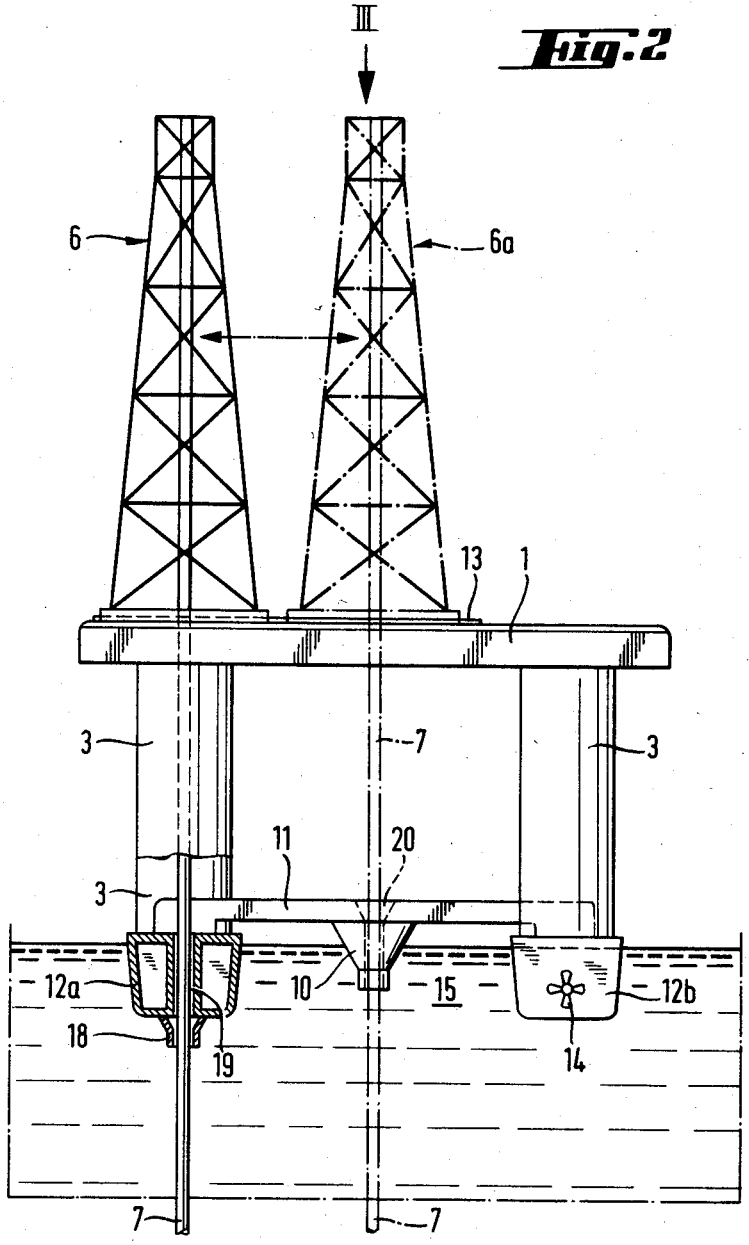
Figure 3:
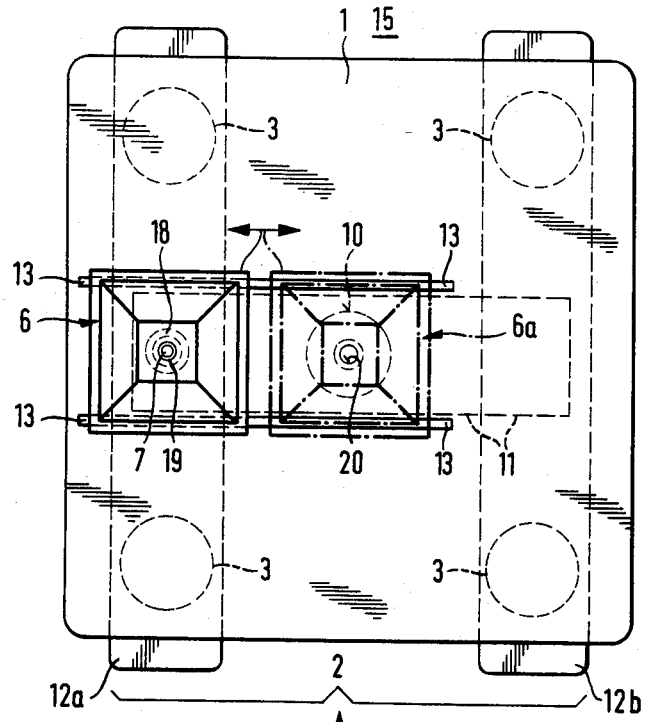
Figure 4:
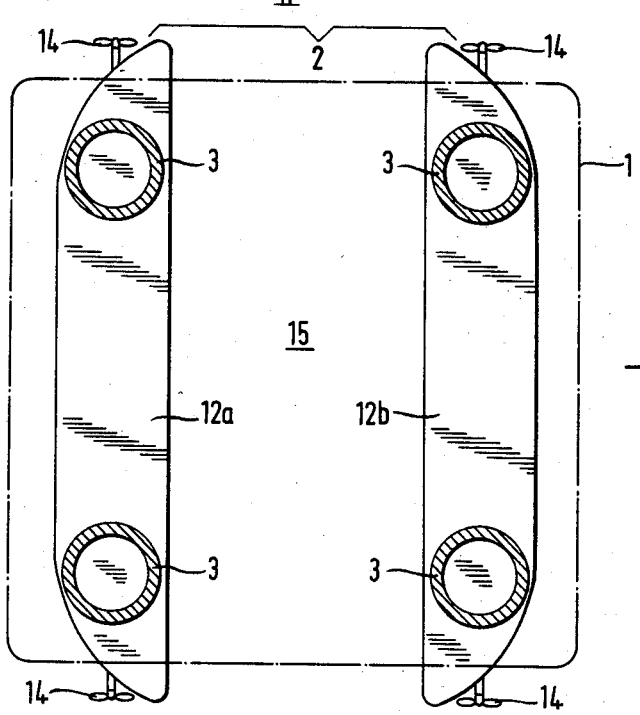

The invention will now be described by way of example, with reference to the accompanying drawing, wherein FIG. 1 is a side view of a platform according to the invention in ice conditions, FIG. 2 is an end view of a second embodiment of a platform according to the invention, FIG. 3 is a top view of the platform of FIG. 2, FIG. 4 is a top view of the pontoon portion of a third embodiment of a platform according to the invention.

In the drawing, 1 refers to the working level portion of a drilling platform and 2 to its pontoon portion. Between these portions there are four columns 3, which support the working level portion. The working level portion is provided with a service building 5, a drilling tower 6 and other necessary constructions and arrangements not shown. A drill shaft 7 has in its lower end a drill, by means of which a hole is drilled into the bottom of the sea. Drill shaft 7 extends straight downwards from the drilling tower 6. When the drilling platform operates in open water, it is submerged so deep, that the water surface is at the level 8. The distance from the water surface to the pontoon portion 2 as well as to the working level portion 1 is so great that not even high waves have any essential influence on either portion. In ice conditions there are no waves, and therefore the platform may then be used in quite another manner. The pontoons of the pontoon portion 2 are formed as ice breaking units. FIG. 1 shows how the ice 17 moving in the direction of arrow 9 is broken against the pontoon portion 2.

In ice conditions drill shaft 7 might be damaged. Because of this a protective structure 10 is arranged around it, as shown in FIG. 2. By means of supports 11 the protective structure is supported on the pontoons 12 of the pontoon portion 2. In really severe ice conditions this structure is not reliable enough. In such a case the solution shown in FIGS. 2 and 3 is recommended. Then the whole drilling tower 6 is moved along rails to a second drilling position *6a*, in which the drill shaft passes through one of the pontoons *12b*. The drill shaft is then very well protected, and just a short shield collar 18 may be needed at the pontoon bottom to protect the drill shaft from ice pieces moving along the pontoon bottom.

At both ends of the pontoons *12a*, *12b* there is at least one propeller 14 designed to withstand severe ice load. Propeller 14 is driven by a powerful prime mover. To avoid wedging of ice pieces between the pontoons, in case the ends of the pontoons *12a* and *12b* are formed to break ice in the most efficient way, the pontoons should be formed so that the space 15 between them is of uniform width over the whole length of the pontoons, or is at least not converging in the ice moving direction at any point. Such a construction is shown in FIG. 4.

The invention is not limited to the embodiments shown, but several modifications thereof are feasible within the scope of the attached claims.

We claim:

1. A method for using a floating semisubmersible off-shore drilling platform or the like in ice-filled waters, which platform comprises a lower pontoon portion having at least one pontoon, an upper working level portion, and columns supporting the working level portion above the pontoon portion, and which platform is movable between an upper position in which it floats with said pontoon portion at the water surface level, and a lower position in which said pontoon portion is at a considerable distance below the water surface and said working level portion is at a considerable distance above the water surface, said method including the steps of transporting the platform to a working location in its upper position, lowering the platform to its lower position, conducting drilling operations at said working location with the platform as a stationary unit in its lower position, and, at the onset of ice conditions, lifting said platform to its upper position and continuing drilling operations at said working location with the platform as a stationary unit in its upper position.

* * * * *